US007293325B2

(12) United States Patent
Moshenrose et al.

(10) Patent No.: US 7,293,325 B2
(45) Date of Patent: Nov. 13, 2007

(54) VACUUM CLEANER BASE PLATE ASSEMBLY

(75) Inventors: Paul A. Moshenrose, Ocean Springs, MS (US); Charles W. Reynolds, Long Beach, MS (US)

(73) Assignee: Oreck Holdings, LLC, Cheyenne, WY (US)

( * ) Notice: Subject to any disclaimer, the term of this patent is extended or adjusted under 35 U.S.C. 154(b) by 747 days.

(21) Appl. No.: 10/693,299

(22) Filed: Oct. 24, 2003

(65) Prior Publication Data

US 2005/0086763 A1 Apr. 28, 2005

(51) Int. Cl.
*A47L 5/00* (2006.01)

(52) U.S. Cl. ..... 15/363; 15/364; 15/367; 15/393; 15/394; 15/401; 15/412

(58) Field of Classification Search ..... None
See application file for complete search history.

(56) References Cited

U.S. PATENT DOCUMENTS 4,754,520 A 7/1988 Steadings et al.
5,230,121 A 7/1993 Blackman
5,774,932 A 7/1998 Mallory et al.
6,375,720 B2 4/2002 Embree et al.
6,381,802 B2 * 5/2002 Park ..... 15/325
2002/0083552 A1 7/2002 Dilger et al.
2002/0124346 A1 9/2002 Steiner et al.

FOREIGN PATENT DOCUMENTS

GB 2046087 A 11/1980
GB 2389035 A 12/2003
WO WO 99/37198 A 7/1999

* cited by examiner

*Primary Examiner*—David Redding
(74) *Attorney, Agent, or Firm*—The Ollila Law Group LLC

(57) ABSTRACT

A vacuum cleaner base plate assembly is provided according to an embodiment of the invention. The base plate assembly includes a base plate adapted to fit to a chassis bottom of a vacuum cleaner. The base plate includes one or more nozzle apertures. The base plate assembly further includes one or more trapped components configured to rest against the base plate. The base plate assembly further includes a skid plate that fits to the base plate and that holds the one or more trapped components against the base plate when the skid plate is assembled to the base plate. The base plate assembly further includes one or more fasteners that removably affix the skid plate to the base plate. The skid plate and the one or more trapped components are removably affixed to the base plate by the skid plate and the one or more fasteners.

19 Claims, 2 Drawing Sheets

VACUUM CLEANER BASE PLATE ASSEMBLY

TECHNICAL FIELD

The present invention relates to a vacuum cleaner base plate assembly.

BACKGROUND OF THE INVENTION

Vacuum cleaners are widely used for picking up dust and debris. A vacuum cleaner therefore includes a motor and fan that generate a vacuum airflow. An upright vacuum cleaner is a popular type of vacuum cleaner, wherein the motor, the fan, and a dust bag are typically mounted on an upright portion of the vacuum cleaner. A head includes a chassis, wheels, a nozzle, and can include a powered brushroll. The chassis bottom can be open or can include a base plate that closes the chassis bottom and encloses major components of the vacuum cleaner head.

In the prior art, the base plate is attached to the chassis bottom by multiple screws. A skid plate can be included, and is typically attached to the base plate by screws. In addition, other components of the vacuum cleaner, such as edge brushes and wipers, are attached to the base plate by screws or other fasteners. As a result, in order to remove or replace these components, each such component must be individually removed by removing one or more corresponding fasteners.

SUMMARY OF THE INVENTION

A vacuum cleaner base plate assembly is provided according to an embodiment of the invention. The vacuum cleaner base plate assembly comprises a vacuum cleaner base plate adapted to fit to a chassis bottom of a vacuum cleaner. The vacuum cleaner base plate includes one or more nozzle apertures. The vacuum cleaner base plate assembly further comprises one or more trapped components configured to rest against the vacuum cleaner base plate. The vacuum cleaner base plate assembly further comprises a vacuum cleaner skid plate that fits to the vacuum cleaner base plate and that holds the one or more trapped components against the vacuum cleaner base plate when the vacuum cleaner skid plate is assembled to the vacuum cleaner base plate. The vacuum cleaner base plate assembly further comprises one or more fasteners that removably affix the vacuum cleaner skid plate to the vacuum cleaner base plate. The vacuum cleaner skid plate and the one or more trapped components are removably affixed to the vacuum cleaner base plate by the vacuum cleaner skid plate and the one or more fasteners.

A vacuum cleaner base plate assembly is provided according to an embodiment of the invention. The vacuum cleaner base plate assembly comprises a vacuum cleaner base plate adapted to fit to a chassis bottom of a vacuum cleaner. The vacuum cleaner base plate includes one or more nozzle apertures. The vacuum cleaner base plate assembly further comprises a wiper blade configured to rest against the vacuum cleaner base plate. The vacuum cleaner base plate assembly further comprises one or more brushes configured to rest against the vacuum cleaner base plate. The vacuum cleaner base plate assembly further comprises a vacuum cleaner skid plate that fits to the vacuum cleaner base plate and that holds wiper and the one or more brushes against the vacuum cleaner base plate when the vacuum cleaner skid plate is assembled to the vacuum cleaner base plate. The vacuum cleaner base plate assembly further comprises one or more fasteners that removably affix the vacuum cleaner skid plate to the vacuum cleaner base plate. The vacuum cleaner skid plate, the wiper, and the one or more brushes are removably affixed to the vacuum cleaner base plate by the vacuum cleaner skid plate and the one or more fasteners.

A method of forming a vacuum cleaner base plate assembly is provided according to an embodiment of the invention. The method comprises providing a vacuum cleaner base plate adapted to fit to a chassis bottom of a vacuum cleaner. The vacuum cleaner base plate includes one or more nozzle apertures. The method further comprises providing one or more trapped components configured to rest against the vacuum cleaner base plate. The method further comprises providing a vacuum cleaner skid plate that fits to the vacuum cleaner base plate and that holds the one or more trapped components against the vacuum cleaner base plate when the vacuum cleaner skid plate is assembled to the vacuum cleaner base plate. The method further comprises providing one or more fasteners that removably affix the vacuum cleaner skid plate to the vacuum cleaner base plate. The vacuum cleaner skid plate and the one or more trapped components are removably affixed to the vacuum cleaner base plate by the vacuum cleaner skid plate and the one or more fasteners.

BRIEF DESCRIPTION OF THE DRAWINGS

The same reference number represents the same element on all drawings. It should be noted that the drawings are not to scale.

DETAILED DESCRIPTION OF THE INVENTION

Figure 1:
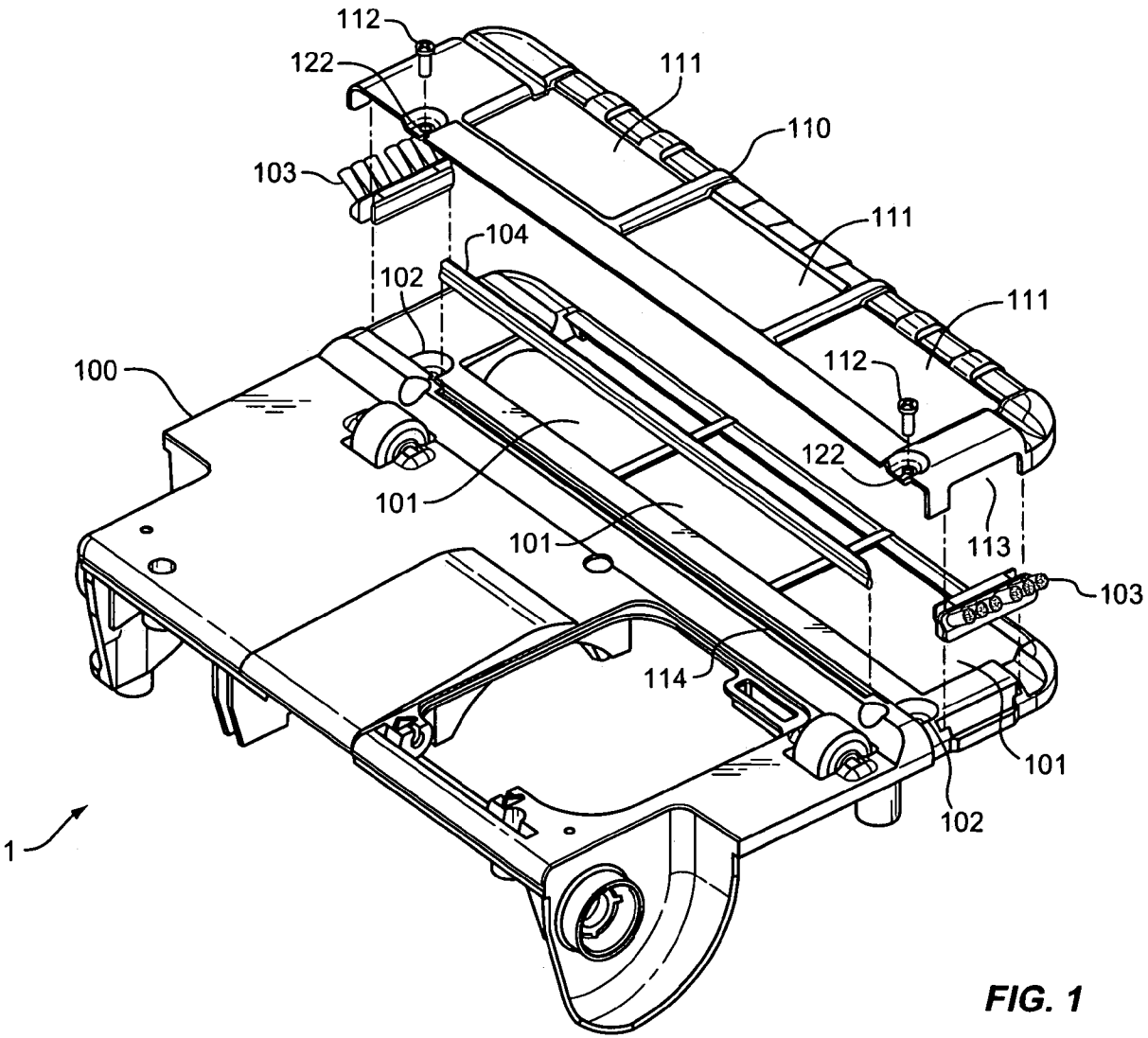
FIG. 1 shows a vacuum cleaner base plate assembly according to an embodiment of the invention.

FIG. 1 shows a vacuum cleaner base plate assembly 1 according to an embodiment of the invention. The base plate assembly 1 in the embodiment shown includes a base plate 100, a skid plate 110, and one or more fasteners 112. In addition, the base plate assembly 1 includes one or more trapped components. In the embodiment shown, the one or more trapped components comprise a wiper 104 and one or more brushes 103. It should be noted that other or additional trapped components can be included, such as other wipers, brushes, bumpers, magnets, etc.

The skid plate 110 can be removably affixed to the base plate 100 by the one or more fasteners 112. The base plate assembly 1 is inverted in the figure, and a corresponding vacuum cleaner chassis would be positioned below the base plate assembly 1 in order to assemble the base plate assembly 1 to the chassis bottom of the vacuum cleaner. When thus assembled, the skid plate 110 traps and holds the one or more trapped components against the base plate 100.

The base plate 100 includes fastener holes 102 corresponding to the one or more fasteners 112. The fastener holes 102 receive the one or more fasteners 112. The base plate 100 further includes a wiper receptacle 114 and one or more base plate nozzle apertures 101. The wiper receptacle 114 is of a size and shape to at least partially receive the wiper 104. A vacuum airflow generated by the vacuum cleaner passes through the one or more base plate nozzle apertures 101 when the base plate 100 is assembled to the vacuum cleaner chassis. In addition, if the vacuum cleaner includes a power brushroll, the brushroll extends through the one or more base plate nozzle apertures 101.

The skid plate 110 includes one or more skid plate nozzle apertures 111 corresponding to and substantially matching up with the one or more base plate nozzle apertures 101 of the base plate 100. The skid plate 110 further includes one or more fastener holes 122 corresponding to and substantially matching up with the one or more fastener holes 102 of the base plate 100. The skid plate 110 further includes cut-outs 113 that accommodate the one or more brushes 103. It should be understood that the base plate 100 can include receptacles that accommodate the one or more brushes 103, as an alternative to or in addition to the cut-outs 113.

The one or more fasteners 112 engage the holes 102 in the base plate 100; The one or more fasteners 112 therefore removably affix the skid plate 110 to the base plate 100. The one or more fasteners 112 can comprise screws or bolts, and the holes 102 can comprise threaded holes or bores. Alternatively, the one or more fasteners 112 can comprise barbed pins, spring clips, or other biased retainers. In another alternative, the fasteners 112 can comprise "tool-less" fasteners or clips of some sort. It should be understood that any manner of fastener can be used to affix the skid plate 110 to the base plate 100.

Any number of fasteners 112 can be employed, including two fasteners 112, as shown. However, it should be noted that the fasteners 112 hold not only the skid plate 110 to the base plate 100, but also trap the trapped components (such as the wiper 104 and the one or more brushes 103, for example) to the base plate 100 as a result of the fasteners 112 attaching the skid plate 10 to the base plate 100. Consequently, the skid plate 110 and the trapped components can all be disassembled from the base plate 100 by removal of the fasteners 112.

The wiper 104 in one embodiment can comprise a resilient or semi-resilient blade. In another embodiment the wiper 104 can comprise a brush. The wiper 104 operates to dislodge or carry along dirt and debris over which the vacuum cleaner is passing, so that the dirt and debris are picked up by the vacuum airflow generated by the vacuum cleaner. The wiper 104 in one embodiment is located behind and substantially parallel to the one or more nozzle apertures 101. However, the wiper 104 can be positioned at other locations and at other orientations, as desired. In addition, the wiper 104 can carry along liquids, so that the liquids are picked up by the vacuum airflow generated by the vacuum cleaner.

The one or more brushes 103 comprise brushes that extend substantially downwardly from the chassis bottom of the vacuum cleaner. The one or more brushes 103 can comprise edge brushes that extend substantially outwardly and substantially downwardly from a side edge of the vacuum cleaner. The one or more brushes 103 function to dislodge and carry along dirt and debris, such as dirt and debris located along the sides of the vacuum cleaner, for example. The one or more brushes 103 can comprise bristles, and can further comprise multiple tufts of bristles.

Figure 2:
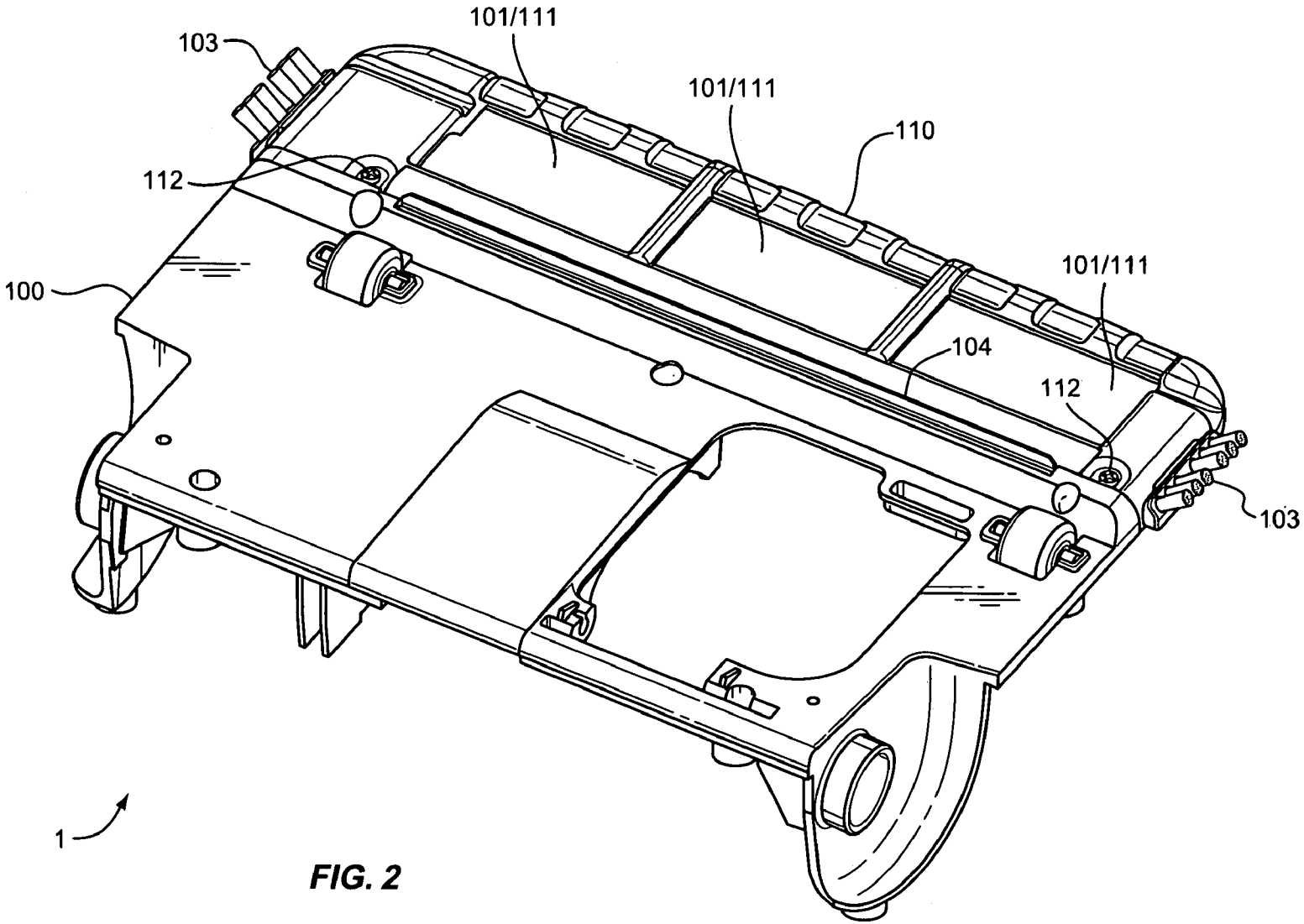
FIG. 2 shows the base plate assembly when fully assembled, wherein a wiper and two edge brushes are trapped between the skid plate and the base plate.

FIG. 2 shows the base plate assembly 1 when fully assembled, wherein the wiper 104 and the one or more brushes 103 are trapped between the skid plate 110 and the base plate 100. The fasteners 112 are holding the skid plate 10 to the base plate 100.

The vacuum cleaner base plate assembly 1 according the invention can provide benefits according to the various embodiments. The base plate assembly 1 provides strength to the vacuum cleaner chassis and protects the vacuum cleaner and the vacuum cleaner chassis from excessive wear. The base plate assembly 1 protects the vacuum cleaner and the vacuum cleaner chassis from damage due to impacts. The base plate assembly 1 improves the serviceability of the vacuum cleaner by allowing the user to access several components by removing one piece, including removing only a limited number of fasteners. The base plate assembly 1 provides trapped components that are not physically attached to the base plate. The base plate assembly 1 provides trapped components that are trapped between the skid plate and the base plate. The base plate assembly 1 provides trapped components that can be removed or replaced merely by removing the skid plate fasteners and the skid plate.

What is claimed is:

1. A vacuum cleaner base plate assembly, comprising:

a vacuum cleaner base plate adapted to fit to a chassis bottom of a vacuum cleaner, with the vacuum cleaner base plate including one or more nozzle apertures;

one or more trapped components configured to rest against the vacuum cleaner base plate;

a vacuum cleaner skid plate that fits to the vacuum cleaner base plate and that holds the one or more tapped components against the vacuum cleaner base plate when the vacuum cleaner skid plate is assembled to the vacuum cleaner base plate; and one or more fasteners that removably affix the vacuum cleaner skid plate to the vacuum cleaner base plate, wherein the vacuum cleaner skid plate and the one or more trapped components are removably affixed to the vacuum cleaner base plate by the vacuum cleaner skid plate and the one or more fasteners.

2. The base plate assembly of claim 1, wherein the one or more vacuum cleaner components includes a wiper blade that extends downwardly from the bottom of the vacuum cleaner and is trapped in a position parallel to a brushroll of the vacuum cleaner.

3. The base plate assembly of claim 1, wherein the one or more vacuum cleaner components includes two edge brushes that extend substantially downwardly and outwardly from the side edges of the vacuum cleaner chassis.

4. The base plate assembly of claim 1, wherein the fasteners comprise screws.

5. The base plate assembly of claim 1, wherein the vacuum cleaner skid plate comprises a metal vacuum cleaner skid plate.

6. The base plate assembly of claim 1, wherein the vacuum cleaner base plate assembly is adapted to fit to an upright vacuum cleaner.

7. The base assembly of claim 1, wherein the vacuum cleaner base plate includes one or more base plate nozzle apertures and the vacuum cleaner skid plate includes one or more skid plate nozzle apertures corresponding to and substantially matching up with the one or more base plate nozzle apertures.

8. A vacuum cleaner base plate assembly, comprising:

a vacuum cleaner base plate adapted to fit to a chassis bottom of a vacuum cleaner, with the vacuum cleaner base plate including one or more nozzle apertures;

a wiper blade configured to rest against the vacuum cleaner base plate;

one or more brushes configured to rest against the vacuum cleaner base plate;

a vacuum cleaner skid plate that fits to the vacuum cleaner base plate and that holds the wiper and the one or more brushes against the vacuum cleaner base plate when the vacuum cleaner skid plate is assembled to the vacuum cleaner base plate; and one or more fasteners that removably affix the vacuum cleaner skid plate to the vacuum cleaner base plate, wherein the vacuum cleaner skid plate, the wiper, and the one or more brushes are removably affixed to the vacuum cleaner base plate by the vacuum cleaner skid plate and the one or more fasteners.

9. The base plate assembly of claim 8, wherein the fasteners comprise screws.

10. The base plate assembly of claim 8, wherein the vacuum cleaner skid plate comprises a metal vacuum cleaner skid plate.

11. The base plate assembly of claim 8, wherein the vacuum cleaner base plate assembly is adapted to fit to an upright vacuum cleaner.

12. The base plate assembly of claim 8, wherein vacuum cleaner base plate includes one or more base plate nozzle apertures and the vacuum cleaner skid plate includes one or more skid plate nozzle apertures corresponding to and substantially matching up with the one or more base plate nozzle apertures.

13. A method of forming a vacuum cleaner base plate assembly, the method comprising:

providing a vacuum cleaner base plate adapted to fit to a chassis bottom of a vacuum cleaner, with the vacuum cleaner base plate including one or more nozzle apertures;

providing one or more trapped components configured to rest against the vacuum cleaner base plate;

providing a vacuum cleaner skid plate that fits to the vacuum cleaner base plate and that holds the one or more trapped components against the vacuum cleaner base plate when the vacuum cleaner skid plate is assembled to the vacuum cleaner base plate; and providing one or more fasteners that removably affix the vacuum cleaner skid plate to the vacuum cleaner base plate, wherein the vacuum cleaner skid plate and the one or more trapped components are removably affixed to the vacuum cleaner base plate by the vacuum cleaner skid plate and the one or more fasteners.

14. The method of claim 13, wherein the one or more vacuum cleaner components includes a wiper blade that extends downwardly from the bottom of the vacuum cleaner and is trapped in a position parallel to a brushroll of the vacuum cleaner.

15. The method of claim 13, wherein the one or more vacuum cleaner components includes two edge brushes that extend substantially downwardly and outwardly from the side edges of the vacuum cleaner chassis.

16. The method of claim 13, wherein the fasteners comprise screws.

17. The method of claim 13, wherein the vacuum cleaner skid plate comprises a metal vacuum cleaner skid plate.

18. The method of claim 13, wherein the vacuum cleaner base plate assembly is adapted to fit to an upright vacuum cleaner.

19. The method of claim 13, wherein the vacuum cleaner base plate includes one or more base plate nozzle apertures and the vacuum cleaner skid plate includes one or more skid plate nozzle apertures corresponding to and substantially matching up with the one or more base plate nozzle apertures.

* * * * *